United States Patent [19]

Balinski

[11] 4,227,360

[45] Oct. 14, 1980

[54] RESILIENT FURRING MEMBER

[75] Inventor: Henry A. Balinski, Hoffman Estates, Ill.

[73] Assignee: United States Gypsum Company, Chicago, Ill.

[21] Appl. No.: 794,185

[22] Filed: May 5, 1977

[51] Int. Cl.[2] ..... E04C 3/30; E04B 5/52; E06B 3/54

[52] U.S. Cl. ..... 52/720; 52/243; 52/346; 52/393; 52/481

[58] Field of Search ..... 52/346, 720, 347, 481, 52/393, 479, 243, 480, 364, 732

[56] References Cited

U.S. PATENT DOCUMENTS

| | | | |
|---|---|---|---|
| 794,845 | 7/1905 | Blaine | 52/720 X |
| 3,090,164 | 5/1963 | Nelsson | 52/481 X |
| 3,177,620 | 4/1965 | Brown et al. | 52/346 X |
| 3,333,390 | 8/1967 | Banning | 52/481 X |
| 3,370,391 | 2/1968 | Dupuis et al. | 52/346 |
| 3,391,508 | 7/1968 | Pestel et al. | 52/346 |
| 3,445,975 | 5/1969 | Nelsson | 52/346 |
| 3,477,187 | 11/1969 | Fruman | 52/346 |
| 3,841,043 | 10/1974 | Zinn | 52/481 X |

*Primary Examiner*—Leslie Braun

*Attorney, Agent, or Firm*—Glenn W. Ohlson; Robert H. Robinson; Kenneth E. Roberts

[57] ABSTRACT

A resilient metal runner for attaching gypsum wallboard to a supporting structure including a base attaching flange with a curved over section merging into a flexible web which is integral with a first flange extending at an inclined angle from an edge of the flexible web and a support portion having one edge coextensive with the adjoining edge of such angled flange in laterally offset relation to the flexible web with an inclined stop flange coextensive with the opposite edge of the support portions and extending at an opposite angle to the first flange and of substantially similar width to the first flange. The flexible web is provided with cutout portions for the securement of fastenings through the base attaching flange.

1 Claim, 3 Drawing Figures

RESILIENT FURRING MEMBER

BACKGROUND OF THE INVENTION

Wall framing of two by four support members is common in the usual wall or ceiling constructions. In wallboard type of wall and ceiling construction the 2"×4" support members support and are covered by gypsum wallboard which may be a single layer of gypsum wallboard or of two ply construction consisting of a gypsum backing board surfaced with a layer of gypsum wallboard. Such structure is widely used because it is strong, inexpensive and readily fabricated. Its use in apartment buildings and multi-unit constructions has been more or less restricted because of its lower resistance to the transmission of sound and thereby fails to secure the privacy preferred by occupants of such buildings. Attempts have been made to solve this provlem and one such method utilizes a staggered stud system. In this system the supporting studs are staggered so that they are spaced and arranged in such manner that alternate support members are coplanar while adjacent support members are offset relative to each other. In the two separate opposed rows of support members one row thus supports the wallboard on one side of the wall while the other row of support members support the wallboard on the other side of the wall. Each side of the wall structure is thus permitted to vibrate independently and therefore substantially independent acoustically. One drawback to such construction is that it requires twice the number of support members normally used and thus results in a substantial increase in expense. Furthermore, this system cannot be adapted for practical applications in ceiling structure.

Another prior method comprises a slotted stud system wherein each support member is slotted along its length, except at its end, to divide the support into two portions separated by a space. This permits the two portions to resonate substantially independently and thus be substantially independent acoustically. Wallboard is applied to such slotted supports as in the usual partition or wall system. A disadvantage of this slotted stud system is that care must be exercised when applying the wallboard so that the fasteners are not driven through the space between slotted portions into the opposite portion and thus destroy the ability of the two portions to resonate independently. Also, such slotted construction cannot be utilized in ceiling structures.

Resilient metal runners have also been used heretofore, and in one such system a plurality of resilient runners are attached to the support members in spaced relationship and disposed to receive wallboard attached thereto. Each such runner comprises an elongate member of sheet metal provided with a base flange secured to the support members and a support surface element of sufficient width to provide for attachment of the meeting edges of adjoining wallboard panels by suitable fasteners. A resilient portion at one edge of the support surface interconnects the support surface with the base flange and thus serves to space the support surface and the attached wallboard from the support members. A stop flange element was disposed along the opposite edge of the support surface element and extended at an angle toward the support members and served to support the support surface element when the wallboard was being applied thereto as by the driving of fasteners. A drawback of this type of runner was that the stop flange was not reinforced and was capable of deflecting when the fasteners were being driven to possibly allow the fasteners to enter the support members and thereby destroy the intended effect of the resilient runner.

SUMMARY OF THE INVENTION

The present invention provides a resilient runner which may be used with wall structures or ceiling constructions, and are such, when installed on the support members, as to provide level coplanar supporting surfaces for application of gypsum boards on the wall and ceiling structures and thus afford smooth surfaces. The resilient runners are spaced apart and since the standard wallboards are four feet in width the spacing of the runners will be about two feet so that the gypsum wallboard can then be applied horizontally or vertically, and thereby take advantage of the flexibility thus afforded in constructing the walls and ceilings. The resilient runners are fully capable of being applied at any desired spacing to utilize wallboards of different widths. Each resilient metal runner, as herein contemplated, comprises an elongate sheet metal runner specifically adapted for attaching wallboard to a supporting structure preferably on both sides thereof, in resiliently spaced relation, so as to prevent sound waves impinging against the wall surfaces from being transmitted directly to the support structure and thus to the opposite wallboard. The vibrations induced in the wallboards will be ultimately dispersed and absorbed so that little, if any, vibration will be transmitted through the support structure. The vibrations are damped and diffused in their travel through the resilient metal runners interposed between the support structure and the wallboard applied on opposite sides thereof. The resilient runner includes a base flange for attaching the runner to support members which can be described as lying in a first plane. A turned over section integrally connects an adjoining edge of the base flange with a flexible web disposed in a laterally spaced and generally parallel relation to the base flange. The flexible web is provided with access openings at longitudinally spaced intervals for the purpose of reaching fastenings through the base flange which attach the metal runner to supporting members. An obtusely angled integral flange extending laterally from the flexible web at an inclined angle integrates the web with an adjoining continuous edge of a support portion disposed in laterally offset parallel relation to the second plane defined by the flexible web. The third plane defined by the support portion is in laterally spaced relation to the second plane and the opposite edge of the support portion includes an obtusely angled flange at an opposite inclination to that defined by the first obtusely angled flange so that they are angled toward each other.

OBJECTS OF THE INVENTION

It is the primary purpose of this invention to provide an improved resilient sheet metal runner for the securement of gypsum wallboards and the like on supporting stud members in a manner to prevent sound waves impinging against the wallboard surfaces from being transmitted directly to the supporting stud members and through the wall structure.

The principal object of the invention is to provide a resilient runner constructed of sheet metal having a base attaching flange and a curved over section integral therewith merging with a flexible web.

An important object of this invention is the provision of a sheet metal resilient runner having a base attaching flange and a curved over section merging with a flexible web overlying the base flange and having openings through the flexible web for access to fastenings through the base flange.

A more specific object of the invention is to provide a resilient sheet metal runner having a base attaching flange and a curved over section integral with a flexible web overlying the base attaching flange in laterally spaced relation thereto and having a support portion integrated with the flexible web at adjoining continuous edges thereof by means of a flange disposed at an inclined angle with respect to the resilient web and support portions and having a stop flange coextensive with an opposite edge of the support portion and integral therewith and inclined at an angle opposite to that of the first inclined flange.

DESCRIPTION OF THE DRAWINGS

The foregoing and other and more specific objects of the invention are attained by the construction and arrangement illustrated in the accompanying drawings wherein.

DESCRIPTION OF PREFERRED EMBODIMENT

Figure 1:
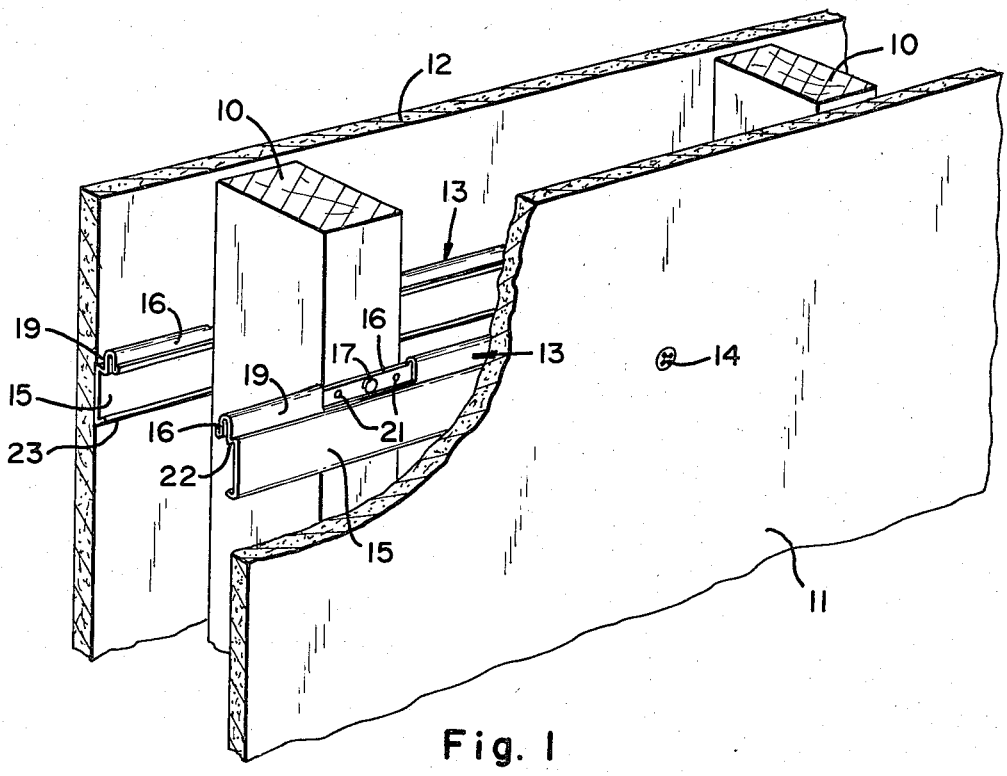
FIG. 1 is a fragmentary general perspective view of a wall structure showing parts in section and portions broken away and wherein gypsum wallboards are illustrated as being mounted upon opposite sides of generally vertical supporting stud members by means of the sheet metal resilient runners of this invention.

In the drawings, as shown in FIG. 1, the construction of the wall illustrated is comprised of a plurality of generally vertically disposed 2"×4" studs or supporting members 10 having gypsum wallboards 11 and 12 mounted upon the opposite sides thereof to form a partition or wall structure. The supporting members 10 of course can be disposed horizontally as in a ceiling structure in which event the gypsum wallboard 11 would be installed upon but one side of the structure at the inside, to form the ceiling. The gypsum wallboards 11 and 12 are applied to the supporting members 10 through the medium of resilient metal runners 13 disposed between the respective wallboard and the supporting members at opposite sides of the members 10.

Only one of the resilient runners 13 is shown at each side of the supports 10 but in an actual structure the runners would be mounted on the supports at regularly spaced intervals throughout the height of the wall structure, or throughout the width of a ceiling structure whereby the gypsum wallboards would be properly and resiliently backed up and supported throughout the entire area of a wall or ceiling structure. The gypsum wallboards, in the form shown, are secured to the resilient sheet metal runners 13 by means of screws 14 here illustrated as comprising Phillips type screws which, as indicated, are disposed flush with the surface of the gypsum board and are threaded into a supporting portion 15 of the metal runner 13 to secure the gypsum board in place. The metal runner 13 is secured to the upright supporting members 10 through a base flange 16 by means of fastenings 17, which are here shown as nails driven through openings provided in the base flange 16 into each of the supporting members 10 to securely mount the metal runners upon opposite sides of the supporting members in the desired spacing and relationship to support the attached gypsum boards in properly spaced relation.

Figure 2:
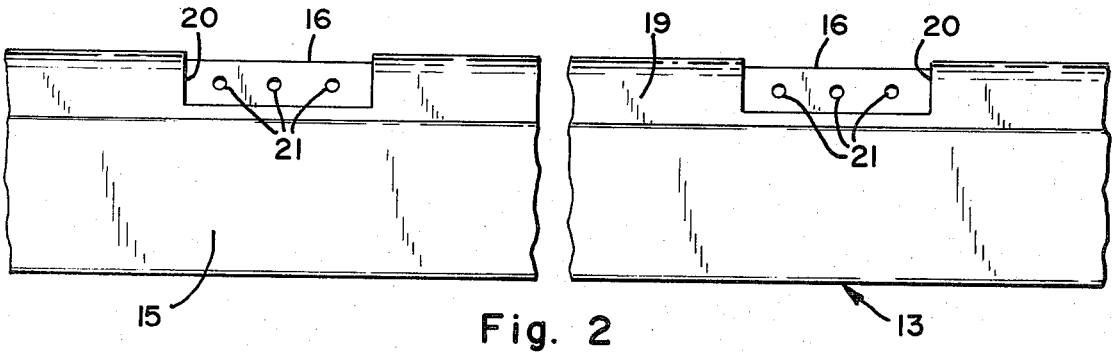
FIG. 2 is an elevational view to larger scale illustrating the sheet metal resilient runner with the flexible web overlying the base attaching flange and revealing the openings through the flexible web affording access to the attachments.
Figure 3:
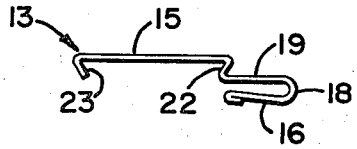
FIG. 3 is a typical cross sectional view through the sheet metal resilient runner.

The resilient sheet metal runners 13 include a turned over curved section 18 merging integrally with a flexible web 19 and which enables the runner 13 to flex and absorb vibrations impinging on the gypsum wallboards secured to the runners. The flexible web 19, as shown in FIGS. 1 and 2, is provided with cut-out portions or openings 20 which afford access to the fastenings 17 securing the base flange 16 to the supporting members 10. The base flange 16 at each opening 20 is provided with a series of holes 21 for the passage of the fastenings 17 in penetrating the supporting members 10 to affix the sheet metal runner 13 on the supporting members. The plurality of holes 21 in the base attaching flanges enables some lengthwise adjustment of the metal runners 13 on the supporting members 10 as afforded by the range of movement longitudinally permitted by the spacing of the holes. The series of holes 21 are disposed in spaced groups along the length of the sheet metal runner and this spacing may be as desired but should preferably accommodate the stud spacing in the wall under construction. As used herein the groups of holes have been disposed on eight inch centers which will accommodate the usual sixteen inch stud spacing and provide for some adjustment. The flexible web 19 is disposed generally parallel in laterally spaced relation to the base attaching flange 16 so that it is free to flex in response to deflections induced by vibrations impinging on the gypsum wallboards 11 and 12.

Along the longitudinal edge of the flexible web 19 an integral flange 22, coextensive with the web, extends laterally and is inclined at an obtuse angle to integrally join along its continuous opposite edge with a contiguous edge of the support portion 15 of the metal runner. The support portion 15 is disposed in laterally displaced parallel relation to the flexible web 19 and occupies a third plane defined thereby. The support portion is provided with a smooth flat surface of extended area which is engaged by gypsum wallboard 11 or 12 and receives the fastening screw 14 driven therethrough. Along the opposite longitudinal edge of the support member an integral stop flange 23 extends laterally in the direction toward the supporting members 19 but spaced therefrom. The stop flange 23 is disposed at an obtuse angle and inclined in a direction opposite to the inclination of the flange 22 so that the two flanges are included toward each other. The flange 23 acts as a limit stop to prevent excessive deflection of the sheet metal runner under forces induced by driving of the screws 14 and reduces the deflection sufficiently to eliminate any possibility of the screws being driven into the supporting members 10.

It can readily be appreciated that resilient metal runner 13 may easily be spliced to an adjacent runner, preferably at the connection to a supporting member 10, to provide a continuous metal runner of extended length. Adjacent metal runners might also be placed in end-to-end abutting relationship, again at the supporting members 10, to form the continuous row of metal runner sections.

The invention has been disclosed as applied to typically wooden 2"×4" supporting members in both wall and ceiling structures but the resilient sheet metal runner of this concept might also be used with other types of constructions including metal fabricated supporting members or with concrete wall structures.

The embodiment disclosed herein is presently considered to be the preferred form of the invention but changes and modifications may be made therein and it is intended that the claims appended hereto shall cover such changes as fall within the scope of this invention.

What is claimed is:

1. A sheet metal resilient runner for the attachment of gypsum wallboard to substantially vertical stud members, said runner comprising a base attaching flange disposed in a first plane, a turned over curved section integral with the base flange and merging into a flexible web having a width substantially equal to said base flange and laterally offset from the base flange thereby being disposed in a second plane in generally parallel spaced relation to said base flange, wherein said flexible web is provided with cut-out portions at longitudinally spaced intervals to expose a portion of said base attaching flange and said base attaching flange is provided with longitudinally spaced groups of attachment holes coinciding with said intervals of the cut-out portions in said flexible web, a first flange integral with said flexible web extending laterally at an obtuse angle from a continuous longitudinal edge of said web, a support portion coextensive and integral with the opposite edge of said first flange and disposed in a third plane in laterally offset generally parallel relation to said web, and a stop flange extending laterally from the opposite longitudinal edge of the support portion, said stop flange being disposed at an obtuse angle and inclined in a direction opposite to the inclination of said first flange so that the stop flange and said first flange incline toward each other.

* * * * *